US006232928B1

(12) United States Patent
Zimmerman et al.

(10) Patent No.: US 6,232,928 B1
(45) Date of Patent: May 15, 2001

(54) ANTENNA MOUNTING BRACKET ASSEMBLY

(75) Inventors: Kurt A. Zimmerman, Atlanta; James W. Maxwell, Norcross, both of GA (US)

(73) Assignee: EMS Technologies, Inc., Norcross, GA (US)

( * ) Notice: Subject to any disclaimer, the term of this patent is extended or adjusted under 35 U.S.C. 154(b) by 0 days.

(21) Appl. No.: 09/497,425

(22) Filed: Feb. 3, 2000

(51) Int. Cl.[7] ..... H01Q 3/02; H01Q 1/12

(52) U.S. Cl. ..... 343/882; 343/890; 343/892

(58) Field of Search ..... 343/882, 890, 343/891, 892, 893; 248/218.4, 219.3, 220.2, 229, 230, 231

(56) References Cited

U.S. PATENT DOCUMENTS

| | | | | |
|---|---|---|---|---|
| 3,373,432 | * | 3/1968 | Breneman | 343/890 |
| 4,563,687 | | 1/1986 | Berger | 343/882 |
| 5,029,799 | | 7/1991 | Bernier | 248/514 |
| 5,707,033 | | 1/1998 | Holt et al. | 248/225.11 |
| 5,787,673 | * | 8/1998 | Noble | 343/890 |
| 6,115,004 | * | 9/2000 | McGinnis | 343/890 |

* cited by examiner

*Primary Examiner*—Tan Ho
(74) *Attorney, Agent, or Firm*—King & Spalding

(57) ABSTRACT

Antenna mounting bracket assembly having a spine, an upper bracket, a lower bracket and a cam bracket for mounting an antenna on a support structure, such as a vertical pole and for providing adjustment of the antenna's downwards tilt position. The spine provides for the proper spacing and rotational alignment between the upper and lower ends of the accompanying antenna. The cam bracket can allow either analog or digital adjustment of the downwards tilt position of the antenna. The assembly can allow for the installation of the antenna upon the support structure by a single technician.

21 Claims, 6 Drawing Sheets

ANTENNA MOUNTING BRACKET ASSEMBLY

TECHNICAL FIELD

The present invention relates to an antenna mounting bracket assembly that allows for the mounting of an antenna and for the adjustment of the mechanical tilt position of such an antenna.

BACKGROUND OF THE INVENTION

Cellular/PCS ("wireless") telephone and communications networks rely upon a system of antennas for connecting cellular/PCS devices to the wireless networks. The antennas and related cellular/PCS devices send and receive radio frequency ("RF") signals between themselves. To optimize this communication, the cellular/PCS antennas are typically mounted on vertical poles that are situated at the top of tall masts, buildings or other structures. These mounting structures, along with the antenna and related hardware, are referred to in the art as "base stations."

As a result of its higher elevation, the antenna is better able to send and to receive an RF signal to and from a cellular/PCS device, i.e., the antenna's "view" of the signal from the cellular/PCS device is improved. The improved view of the antenna results from the fact that the antenna is positioned at an elevation above hills, buildings, trees and/or other such objects that may impede and/or obstruct the propagation of the RF signal.

The use of mechanical downtilt in an antenna mounting can prevent the RF signal emanating from the antenna from passing over a cellular/PCS device that is located near the antenna and can prevent RF signal interference between the relevant antenna and other cellular/PCS base stations. This enables the antenna's RF signal to be directed downwards toward cellular/PCS device users and away from other cellular/PCS base stations.

Typically, cellular/PCS base stations utilize antennas that are directed at a downtilt angle of 0° to 10° from the base station's horizontal axis and that are operated with a half-power beamwidth RF signal. As a result, the mechanical pointing mechanism for the antenna must be capable of providing downtilt adjustment tolerance of one degree (1°) or less and providing an operator with a clear indication of such downtilt adjustment.

Mounting brackets for use with cellular/PCS antennas are well known in the art. Antenna manufacturers typically include hardware for mounting their antennas to poles and for adjusting the mechanical downtilt of the antenna. Because cellular/PCS antennas are often long and slender and mounted perpendicular to the base station's horizontal axis, prior mounting brackets typically secure the antenna to the pole using two separate, unconnected mounting brackets.

Typically, one of the brackets is attached to the antenna's upper end and the other bracket is attached to the antenna's lower end. The antenna's downtilt position is induced by pivoting the antenna around the lower mounting bracket. The top bracket can be used for moving the position of the upper end of the antenna about the lower bracket pivot point and as a means for locking the downtilt position of the antenna into the desired position.

There are several disadvantages associated with these prior art mounting assemblies. First, two separate, unconnected mounting brackets require vertical adjustment relative to each other based upon the length of the antenna and alignment of the azimuth rotation of each bracket to allow for an accurate and non-binding downtilt adjustment. In addition, once the antenna is attached to the lower mounting bracket, a second installation technician is required to hold the antenna in a proper, upright position while the primary technician attaches the upper mounting bracket to the antenna.

Prior art mounting brackets have primarily utilized either a "scissors"-type upper bracket or an upper bracket with an adjustable linear slot to adjust the downtilt position of the antenna. There are several disadvantages associated with each of these types of upper brackets. First, with respect to linear slot brackets, friction tends to make adjustment throughout the range of motion of the slot difficult and the linear slot assembly may bind as a result. Further, a linear slot assembly does not allow for exact, digital adjustment of an antenna's downtilt position. Next, with respect to scissors-type brackets, such brackets normally consist of at least three linkage parts in addition to the upper mounting bracket and, therefore, increase manufacturing and installation time and expense. Also, such brackets typically are adjusted and locked into position through the use of small pins or rods or by tightening the hinge pivot bolt. As a result, assembly and adjustment of these brackets is difficult and time-consuming.

Subsequently, there is a need for an antenna mounting assembly that allows for installation of an antenna by a single installation technician, that reduces that number of parts necessary to complete the installation thereby reducing manufacturing and installation time and expense, that can be modified easily to provide for either analog or digital adjustment of the antenna's downtilt position and that allows for non-binding, readily identifiable adjustment of the antenna's downtilt position.

SUMMARY OF THE INVENTION

The foregoing problems in the prior art for mounting an antenna, such as a cellular/PCS antenna, are solved by the present invention by providing correct spacing and rotational alignment between the upper and lower ends of the antenna. The invention provides this mounting improvement by utilizing a spine that joins upper and lower mounting brackets into a single, unified mounting bracket assembly. The invention also solves problems in the prior mounting systems related to adjustment of the antenna's downtilt position. The invention provides this improvement by utilizing a radial cam bracket system that is easily installed and adjusted either in an analog or digital fashion. The invention can eliminate the need for an additional technician during the assembly process. For example, the invention can use either a pivot slot and crossbar attachment system for the lower mounting bracket or a radial cam bracket system that utilizes an open-ended "hanger" slot. Both of these attachment systems provide a novel means for retaining the antenna in a substantially upright, vertical position after it is mounted on the mounting bracket. This advantage allows for the completion of the assembly of an antenna base station with the use of only a single technician.

Generally described, the present invention provides an antenna mounting bracket assembly for attaching an antenna to a support structure, such as a vertical pole. This bracket assembly provides a spine that maintains a spaced-apart relationship between two mounting brackets attached to the spine. The spine also maintains an identical azimuth rotation position between the two mounting brackets. The first mounting bracket is typically positioned above the second mounting bracket and fixed onto the spine. The second mounting bracket also can be fixed in position below the first mounting bracket on the spine. The first and second mounting brackets function as receptacles for accepting antenna mounting devices.

The assembly also includes a cam bracket that is adapted to connect the upper end of the antenna and received by the mounting bracket while allowing for the slidable adjustment of the downward tilt position of the antenna relative to the vertical axis of the support structure. The lower mounting bracket is adapted to receive the lower end of the antenna and to allow for the pivotal adjustment of the antenna about the lower mounting bracket.

More particularly, the upper and lower mounting brackets contain slots for accepting band clamps which are used to attach the mounting bracket assembly to the support structure. The lower mounting bracket includes a pair of spaced-apart "L"-shaped mounting slots for slidably accepting a horizontal fastener that is attached to the antenna. These mounting slots allow the antenna to pivot about the lower mounting bracket. The lower mounting bracket may also include a crossbar below and between the mounting slots which, in combination with the "L"-shaped slots, prevents the antenna from extending beyond a predetermined downtilt position when an antenna is placed in the mounting slots.

The cam bracket can include two spaced-apart radial slots that are in alignment with each other and that allow the upper end of the antenna to pivot relative to the pivot point of the lower mounting bracket. In this aspect, the cam bracket also includes a guiding fastener that serves to connect the upper end of the antenna to the cam bracket. The guiding fastener can slidably move between and within the radial slots so as to allow for the analog adjustment of the downtilt position of the antenna. The guiding fastener may also be capable of locking the cam bracket and, therefore, the antenna into a chosen downtilt position. The cam bracket and/or guiding fastener may be marked with a position indicator so as to allow an installation technician to readily identify the downtilt position of the antenna.

In addition to the primary set of radial slots, the cam bracket may have a second set of radial slots that are located near to the connection point between the cam bracket and the upper mounting bracket. In this aspect, the cam bracket includes a second guiding fastener that slidably moves between and within the secondary radial slots so as to allow for the analog adjustment of the downtilt position of the antenna and to prevent the cam bracket from binding during such adjustment. The second guiding fastener may also be capable of locking the cam bracket and, therefore, the antenna into a chosen downtilt position.

In another aspect of the invention, the cam bracket includes two spaced-apart radial slots that are in alignment with each other and that allow the upper end of the antenna to pivot relative to the pivot point of the lower mounting bracket. In this aspect, the radial slots comprise a series of detents extending along their edges. The detents allow for the exact, digital adjustment of downtilt position by moving the guiding fastener into a chosen detent.

In yet another aspect of the invention, the cam bracket includes a secondary set of spaced-apart radial slots that are in alignment with each other and that are open at one end. The secondary radial slots are adapted to slidably mount upon a guiding fastener that is installed in the upper mounting bracket. In addition, the upper mounting bracket contains a set of spaced-apart linear slots that are in alignment with each other and that are open at one end. The linear slots are adapted for slidably receiving a guiding fastener that is installed in the cam bracket. The combination of secondary radial slots and linear slots are utilized to allow the antenna and attached cam bracket to be mounted upon the upper mounting bracket. This slot combination enables the antenna to be retained upon the upper mounting bracket in a substantially vertical position when the antenna is unattached to the lower mounting bracket. In this aspect, the lower mounting bracket includes a spaced-apart set of mounting holes for receiving a fastener for connecting the lower end of the antenna to the mounting assembly and for allowing the antenna to be pivoted about the lower mounting bracket.

In view of the foregoing, it will be appreciated that the present invention and its various embodiments will be more fully understood from the detailed description below, when read in connection with the accompanying drawings, and in view of the appended claims.

DETAILED DESCRIPTION OF THE EXEMPLARY EMBODIMENT

The present invention is directed to an improved antenna mounting bracket assembly for mounting an antenna to a support. The antenna mounting bracket assembly includes a spine that joins two mounting brackets to form a single, unified mounting bracket assembly. A cam bracket can be used for adjusting the downtilt position of an accompanying cellular/PCS antenna. The spine provides for correct vertical and rotational spacing between the upper and lower mounting brackets. In addition, the mounting bracket assembly can be constructed to allow for either variable, analog adjustment of the antenna downtilt position or to allow for fixed, digital adjustment of the antenna downtilt position. The mounting bracket assembly allows for the installation of the assembly and antenna by a single installation technician.

Figure 1:
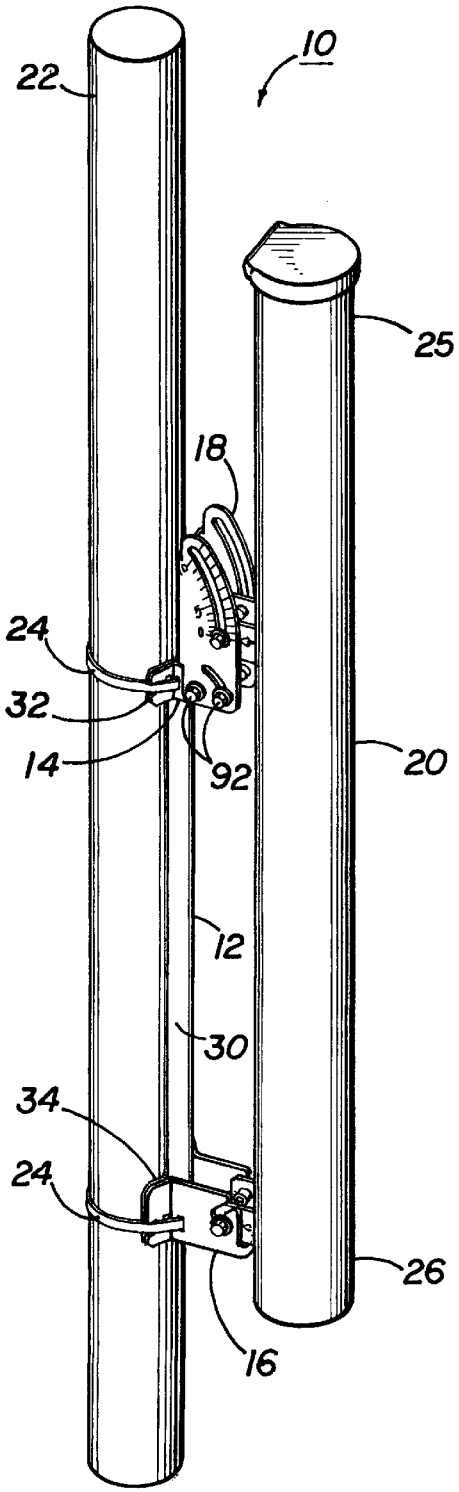
FIG. 1 is a perspective view of an antenna mounting bracket and accompanying cellular/PCS antenna assembled on a vertical pole according to an exemplary embodiment of the present invention.
Figure 2A:
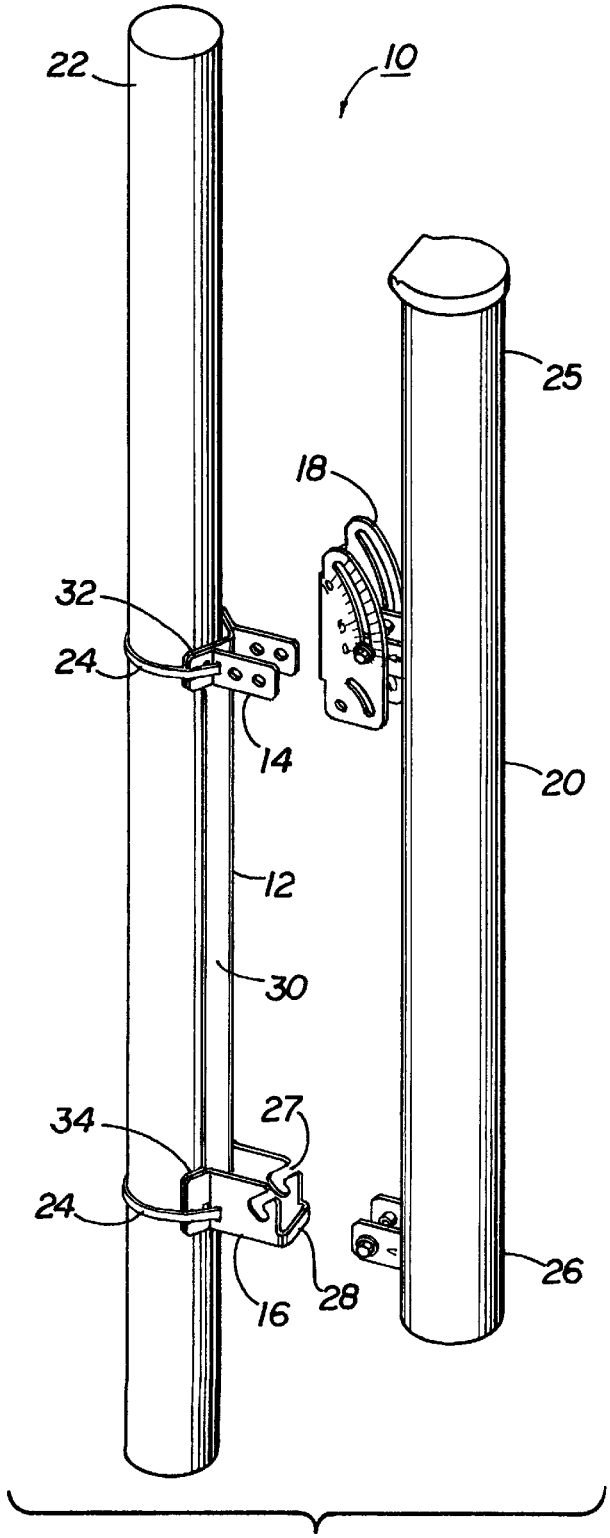
FIG. 2A. is an exploded perspective view of the antenna mounting bracket and accompanying cellular/PCS antenna of FIG. 1.
Figure 2B:
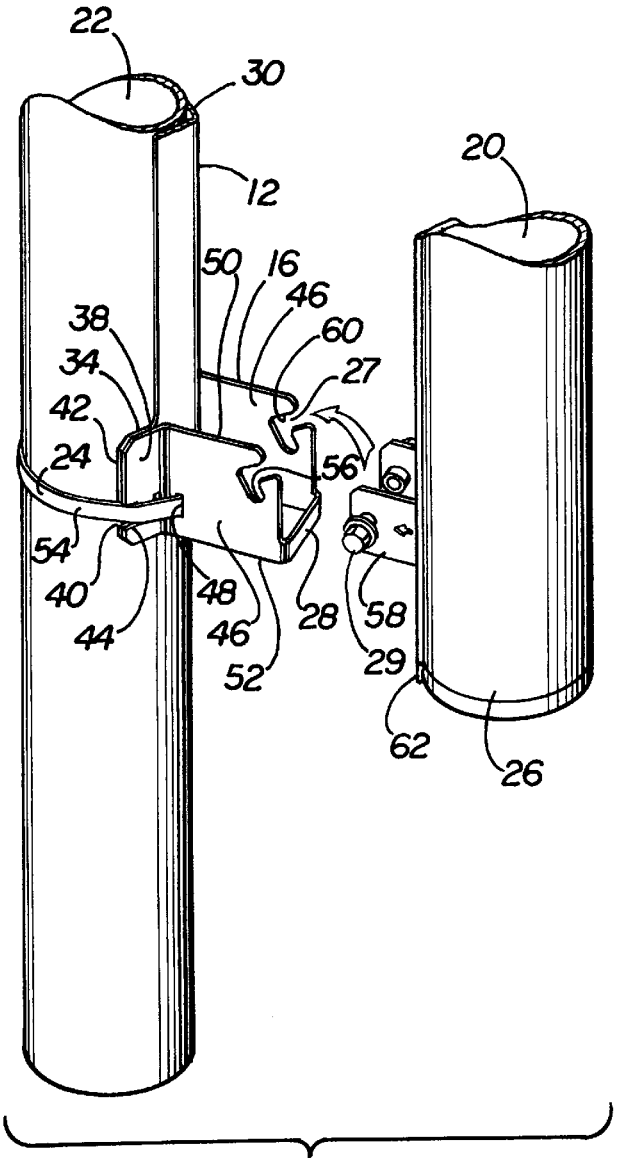
FIG. 2B is an enlarged view of the bottom portion of the antenna mounting bracket and accompanying antenna of FIG. 1.

FIGS. 1, 2A and 2B provide perspective and enlarged views of an exemplary antenna mounting bracket assembly 10 constructed in accordance with the present invention. Turning now to FIGS. 1, 2A and 2B, in an exemplary embodiment, the antenna mounting assembly 10 includes a spine 12, an upper mounting bracket 14, a lower mounting bracket 16 and a cam bracket 18. The spine 12 maintains a spaced-apart relationship between the lower mounting bracket 16 and the upper mounting bracket 14 at a length that is typically shorter than the length of an accompanying cellular/PCS antenna 20. In addition, the spine 12 maintains the identical azimuth rotation relative to the spine's vertical axis between the lower mounting bracket 16 and the upper mounting bracket 14. The complete antenna mounting bracket assembly 10 is attached to a support structure, such as a vertical pole 22, by fasteners, such as band clamps 24. The cam bracket 18 can be connected to the upper mounting bracket 14 and the upper end 25 of the antenna 20. The lower mounting bracket 16 is preferably connected directly to the lower end 26 of the antenna 20. It will be appreciated that the upper and lower mounting bracket 14 and 16 operate as receptacles to receive antenna mounting devices.

In this embodiment, the antenna mounting assembly 10 utilizes a radial cam bracket 18, which forms a cam mechanism to produce variation in the antenna's downtilt position by manipulating the position of the upper end 25 of the antenna 20. The assembly 10 also utilizes a slotted pivot mechanism in the lower mounting bracket 16 to correspond to the variation of the antenna's downtilt position.

As best shown in FIG. 2B, the antenna 20 in this embodiment is mounted upon the lower mounting bracket 16 by placing a pair of guiding fasteners 29 into a pair of spaced-apart "L"-shaped slots 27 formed into the lower mounting bracket 16. The lower mounting bracket 16 also includes a crossbar 28 that is formed below and between the "L"-shaped slots 27. The crossbar 28, in combination with the "L"-shaped slots 27, allows the antenna 20 to be mounted on the lower mounting bracket 16, but prevents it from extending beyond a predetermined downtilt position when the antenna 20 is unattached to the cam bracket 18.

Figure 3:
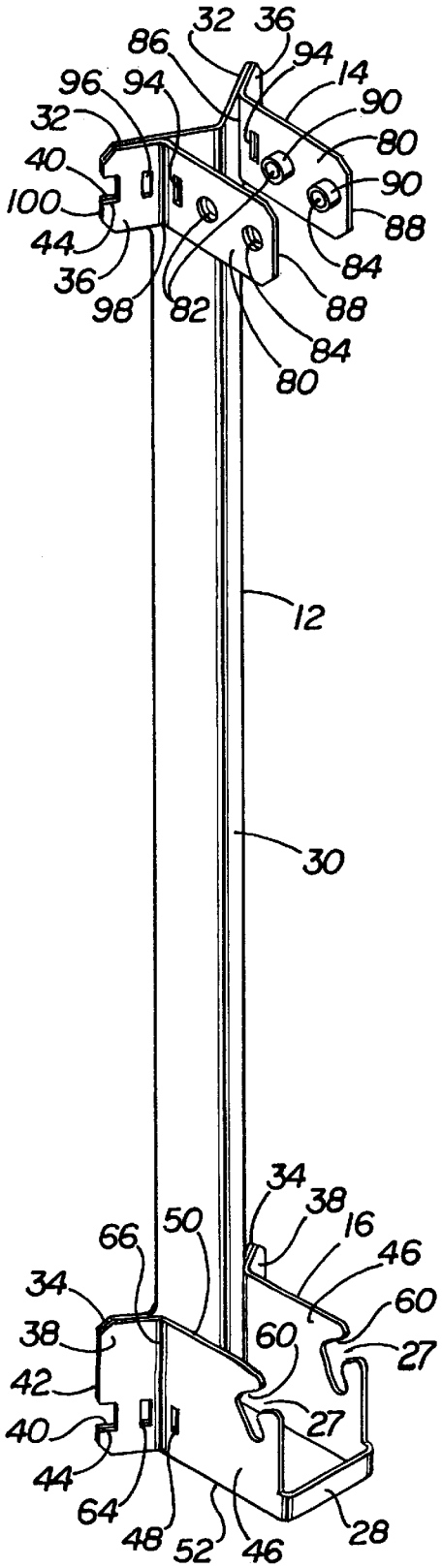
FIG. 3 is a perspective view of the unassembled antenna mounting bracket of FIG. 1 with the downtilt cam bracket removed from the antenna mounting bracket.

FIG. 3 provides a perspective view of the mounting bracket assembly 10 with the cam bracket 18 detached from the assembly 10. In this embodiment, as shown in FIG. 3, the spine 12, lower mounting bracket 16 and upper mounting bracket 14 are constructed as a single, unified assembly by forming and welding sheet metal. This method of construction is well known in the art, is inexpensive and reduces the number of pieces to be assembled during the installation process. In this embodiment, the spine 12 is formed as a "V"-shaped channel 30, which is particularly adapted for attachment to a cylindrical support structure, such as a vertical pole 22. The spine 12 is formed with a set of tabs 32, 34 at each end that are disposed at an angle parallel to that of the "V"-shaped channel 30. The tabs 32, 34 are adapted for attaching to corresponding tabs 36, 38 on the lower mounting bracket 16 and upper mounting bracket 14 by means including but not limited to welding, fusing and adhesives.

A set of spaced-apart, open rectangular slots 40 are cut or "punched" into the tabs 32, 34. Each slot 40 is positioned at the distal end 42 of the tabs 32, 34 and parallel to the spine's vertical axis. These slots 40 are identical in size and shape to a set of slots 44 punched in the tabs 36, 38 formed as part of the lower mounting bracket 16 and the upper mounting bracket 14 described below.

The lower mounting bracket 16 is formed with two sidewalls 46 that are disposed parallel to each other and perpendicular to the spine's vertical axis. A pair of rectangular slots 48 are punched into the sidewalls 46 parallel to the spine's vertical axis, near the sidewalls' proximal ends 50 and towards the sidewall's lower edge 52. These slots 48 are adapted for receiving the strap 54 of a band clamp 24 for attaching the antenna mounting assembly 10 to a support structure.

An open "L"-shaped slot 27 is also punched into each sidewall 46. A crossbar 28 is formed between the sidewalls 46 and below the lower, closed end 56 of the "L"-shaped slots 27. The lower mounting bracket 16 also includes a crossbar 28 that is formed between the sidewalls 46 and below the "L"-shaped slots 27.

As can be seen more clearly in FIG. 2B, the antenna 20 is mounted upon the lower mounting bracket 16 by slidably placing a guiding fastener (or fasteners) 29, such as a nut and bolt combination, rods, bolts or pins, into the "L"-shaped slots 27, which are adapted to receive the guiding fastener (or fasteners) 29. The guiding fastener (or fasteners) 29 is attached to a coupling bracket 58 that is formed into the lower end 26 of the antenna 20. After the antenna 20 is slidably mounted into the "L"-shaped slots 27, the guiding fastener (or fasteners) 29 may be allowed to rest against the upper edge 60 of the "L"-shaped slots 27 and the lower edge of the frame 62 of the antenna 20 may be allowed to rest against the crossbar 28. This combination prevents the antenna 20 from extending beyond a predetermined downtilt position thereby allowing a single installation technician to connect the cam bracket 18 to the upper mounting bracket 14 without the assistance of a second installation technician.

Referring again to FIG. 3, the lower mounting bracket 16 also includes two tabs 38, which are disposed at an angle parallel to that of the spine's corresponding tabs 34. A set of rectangular slots 64 are punched into the tabs 38 parallel to the spine's vertical axis and near a proximal tab 66. The slots 64 are adapted to receive the strap of a smaller diameter band clamp 68 for attaching the mounting bracket assembly 10 to a smaller diameter mounting structure 70. A second set of open rectangular slots 44 are punched into the distal ends of the tabs 38 parallel to the spine's vertical axis. The slots 44 are adapted to receive the strap of a larger diameter band clamp 76 for attaching the mounting bracket assembly to a larger diameter mounting structure 78.

In this embodiment, the mounting bracket assembly 10 includes an upper mounting bracket 14 that is formed with two sidewalls 80 that are disposed parallel to each other and preferably parallel to the sidewalls 46 of the lower mounting bracket 16 and perpendicular to the spine's vertical axis. Two sets of holes 82, 84 are punched into the sidewalls 80 along the horizontal axis of the sidewalls 80. One set of holes 82 is located near the proximal end 86 of the sidewalls 80. Another set of holes 84 is located near the distal end 88 of the sidewalls 80. Short, cylindrical mounting sleeves 90 are press-fit into each of the sidewall holes 82, 84. As can be seen more clearly in FIG. 1, each set of mounting sleeves 90 are adapted for receiving a guiding fastener (or fasteners) 92, including but not limited to a bolt and nut combination, rods or pins. A pair of rectangular slots 94 are punched into the sidewalls 80 parallel to the spine's vertical axis, near the sidewalls' proximal ends 86.

As shown in FIG. 3, the upper mounting bracket 14 also includes two tabs 36, which are disposed at an angle parallel to that of the spine's corresponding tabs 32. A set of rectangular slots 96 are punched into the side walls 80 parallel to the spine's vertical axis and near the proximal end 98 of each tab 36. The slots 96 are adapted for receiving the strap of a smaller diameter band clamp 68 for attaching the mounting bracket assembly to a smaller diameter mounting structure 70. A second set of rectangular slots 44 are punched into the tabs 36 parallel to the spine's vertical axis. Each slot 44 is positioned at the distal end 100 of the tab 36 and is adapted to receive the strap of a larger diameter band clamp 76 for attaching the mounting bracket assembly to a larger diameter mounting structure 78.

Figure 4A:
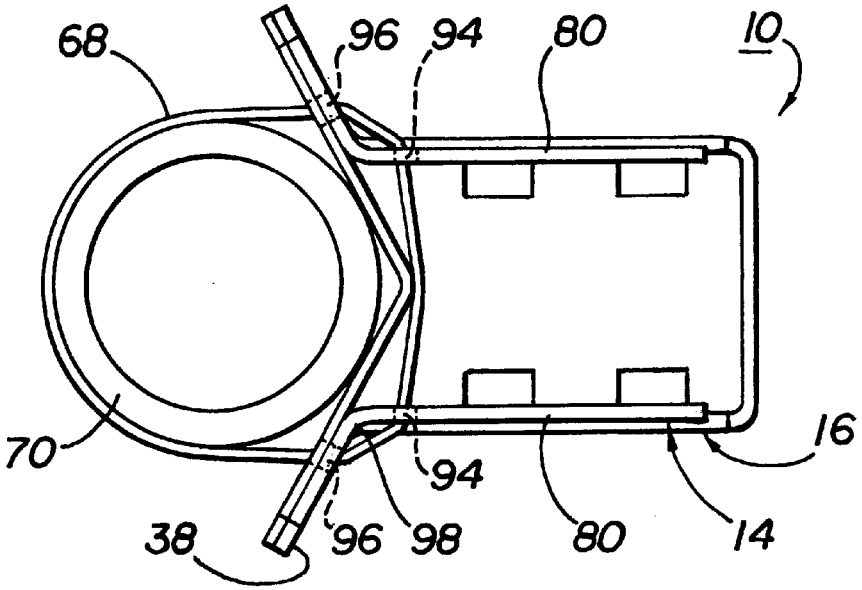
FIG. 4A is a top view of the antenna mounting bracket of FIG. 1 mounted on a small diameter vertical pole.
Figure 4B:
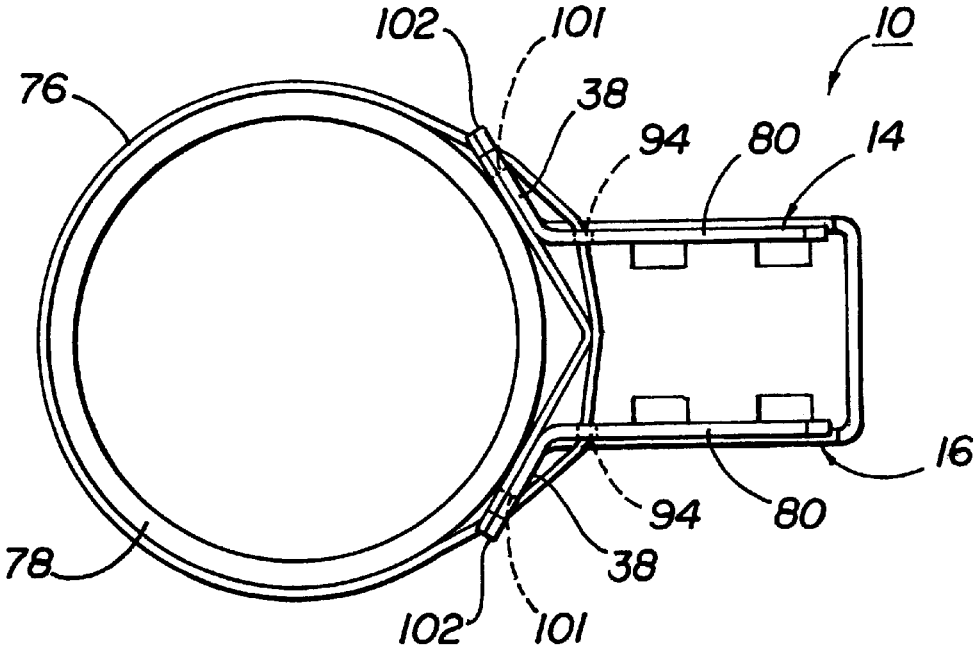
FIG. 4B is a top view of the antenna mounting bracket of FIG. 1 mounted on a large diameter vertical pole.

FIGS. 4A and 4B provide top views of the mounting bracket assembly 10 connected to two support structures 70, 78, namely a small diameter vertical pole 70 in FIG. 4A and a large diameter vertical pole 78 in FIG. 4B. In FIG. 4A, the strap of a small diameter band clamp 68 is passed through the set of slots 94 punched in the sidewalls 80 of the upper mounting bracket 14 and through the set of slots 96 located nearer to the proximal end 98 of the tabs 38 of the upper mounting bracket 14. In FIG. 4B, a strap of a larger diameter band clamp 76 is passed through the set of slots 94 punched in the sidewalls 80 of the upper mounting bracket 14 and through the set of slots 101 located at the distal end 102 of the tabs 38 of the upper mounting bracket 14. By tightening the band clamps 68, 76 the upper and lower mounting brackets 14, 16 and, therefore, the entire mounting bracket assembly 10, are rigidly connected to the support structure 70, 78.

Figure 5:
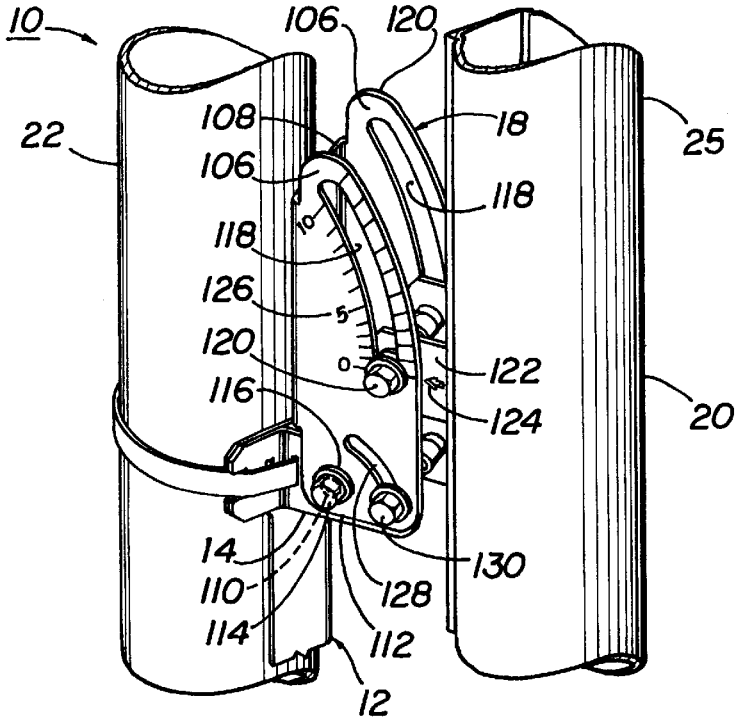
FIG. 5 is a view of the upper portion of the antenna mounting bracket and accompanying cellular/PCS antenna of FIG. 1.

FIG. 5 provides a perspective view of the upper portion of the antenna mounting bracket assembly 10. In this embodiment, a cam bracket 18 is connected to both the upper mounting bracket 14 and the upper end 25 of the antenna 20. The cam bracket 18 is formed with two sidewalls 106 that are parallel to each other and with a rear wall 108 that is perpendicular to the sidewalls 106. A set of holes 110 is punched in the proximal end 112 of sidewalls 106 and are adapted for receiving a pivoting fastener 114 to connect the cam bracket 18 to the upper mounting bracket 14. After it is attached thereto, the cam bracket 18 pivots about the pivoting fastener's connection point. In addition, the pivoting fastener 114 may provide for locking the antenna's downtilt position through the use of a locking fastener 116, such as a locking nut or locking washer.

Two radial slots 118 are punched in the sidewalls 106 of the cam bracket 18 and are located near the distal end 120 of the cam bracket 18 and are formed along congruent radii. The radial slots 118 are adapted to receive a guiding fastener (or fasteners) 120, such as a bolt and nut combination, rods or pins. The guiding fastener (or fasteners) 120 is also attached to a coupling bracket 122 that is formed into the upper end 25 of the antenna 20. The combination of the radial slots 118 and the guiding fastener (or fasteners) 120 provide a slidable cam mechanism that allows for the analog, slidable adjustment of the antenna's downtilt position. In this embodiment, the slots 118 are formed so as to allow for a maximum downtilt position of ten degrees (10°). However, the slots 118 can be reduced and/or increased in length and radius so as to allow for a greater or smaller range of adjustment. In addition, the guiding fastener (or fasteners) 120 may provide for locking the antenna's downtilt position through the use of a locking fastener 120, such as a locking nut or locking washer. In this embodiment, the cam bracket 18 is constructed of sheet metal and is marked about the radial slots 118 so as to readily indicate the antenna's downtilt position. The slots 118 may be marked by conventional methods including metal stamping, engraving or printing. In addition, the coupling bracket 122 that is formed as part of the antenna 20 can be marked with an position indicator 124 that corresponds with the position markings 126 on the radial slots 118 so as to indicate readily the antenna's downtilt position.

In this embodiment, two additional radial slots 128 can be punched in the sidewalls 106 of the cam bracket 18, near the proximal end 112 of the cam bracket 18, and formed to follow congruent radii. These radial slots 128 are adapted to slidably receive a guiding fastener (or fasteners) 130, such as a bolt and nut combination, rods or pins, so as to connect the cam bracket 18 to the upper mounting bracket 14 and to allow the slidable adjustment of the antenna's downtilt position. This additional set of radial slots 128 provides a more stable adjustment of the antenna's downtilt position and prevents the cam bracket 18 and upper mounting bracket 14 from binding during such adjustment. The guiding fastener 130 associated with the additional set of radial slots 128 may also provide for locking the antenna's downtilt position through the use of a locking fastener 130, such as a locking nut or locking washer.

Figure 6:
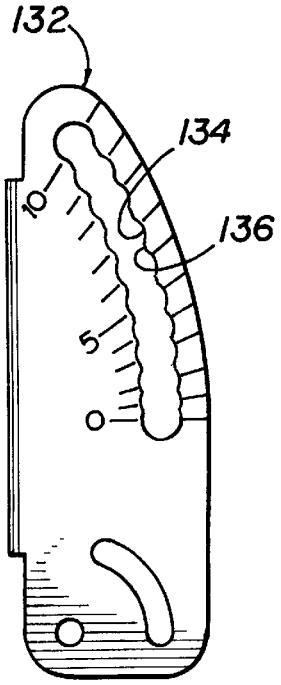
FIG. 6 is a view of a downtilt cam bracket section of an antenna mounting bracket assembly according to an exemplary embodiment of the present invention.

FIG. 6 provides a side view of a cam bracket 132 of another embodiment of the present invention. In this embodiment, the primary set of radial slots 134 are punched into the cam bracket in the form of a series of detents 136 that run along the length of the radii of the slots 134. The detents 136 are disposed relative to each other such that the guiding fastener 130 may be moved digitally between each detent position. This enables an adjustment of the antenna's downtilt position by an exact, digital amount, shown in FIG. 6 in one degree (1°) increments up to a maximum of ten degrees (10°).

Figure 7:
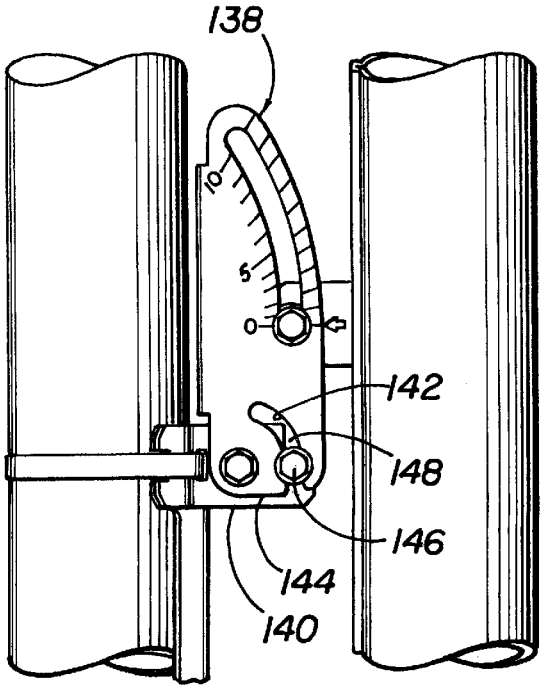
FIG. 7 is a view of the top portion of an antenna mounting bracket and accompanying cellular/PCS antenna assembled on a vertical pole according to an exemplary embodiment of the present invention.

FIG. 7 provides a side view of a cam bracket 138 and an upper mounting bracket 140 of another embodiment of the present invention. In this embodiment, a secondary set of open radial slots 142 are punched into the proximal end 144 of the cam bracket 138. The radial slots 142 are adapted for slidably receiving a guiding fastener (or fasteners) 146 connected to linear slots 148 of the upper mounting bracket 140. The guiding fastener (or fasteners) 146 may also provide for locking the antenna's downtilt position through the use of a locking fastener (or fasteners) 146, such as a locking nut or locking washer.

Figure 8A:
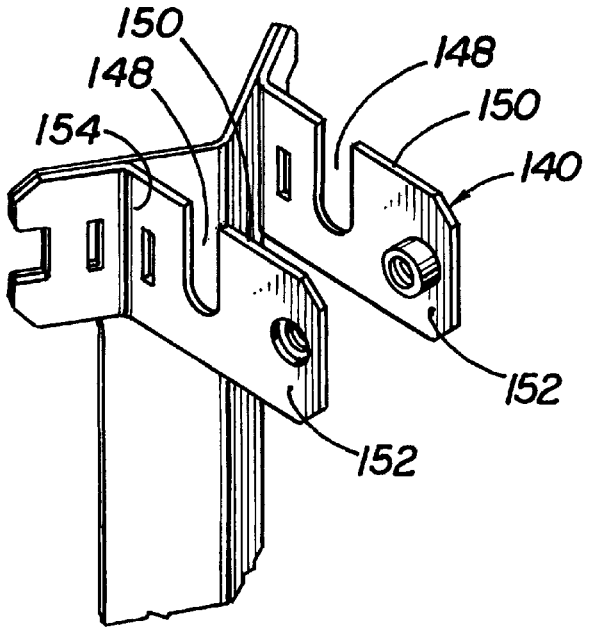
FIG. 8A is a view of an upper mounting bracket section of an antenna mounting bracket assembly according to an exemplary embodiment of the present invention.

As best seen in FIG. 8A, in this embodiment, a set of open linear slots 148 can be punched into the upper edge 150 of the sidewalls 152 of the upper mounting bracket 140 and are parallel to each other and the spine's vertical axis and are located equidistant from the proximal end 154 of the sidewalls 152. The linear slots 148 are adapted for slidably receiving a guiding fastener (or fasteners) 146 that is connected to the cam bracket 138. The guiding fastener (or fasteners) 146 associated with the linear slots 148 may also provide for locking the antenna's downtilt position through the use of a locking fastener (or fasteners) 146, such as a locking nut or locking washer.

Figure 8B:
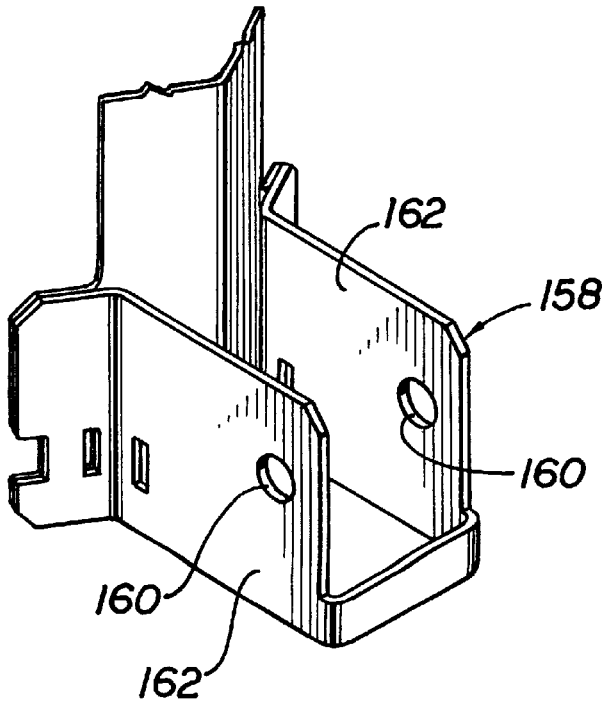
FIG. 8B is a view of a lower mounting bracket section of an antenna mounting bracket assembly according to an exemplary embodiment of the present invention.

As seen in FIG. 8B, in this embodiment, the lower mounting bracket 158 contains a set of pivot holes 160 disposed within its sidewalls 162. These holes 160 are adapted for pivotally receiving a fastener (or fasteners). The fasteners (or fasteners) associated with the pivot holes 160 can also provide for locking the antenna's downtilt position through the use of a locking fastener, such as a locking nut or locking washer.

The combination of the open linear slots 148 and the open radial slots 142 allow an installation technician to mount the assembled cam bracket 138 and antenna 20 upon the upper mounting bracket 140 while maintaining the antenna 20 in a substantially vertical position while the antenna 20 is unattached to the lower mounting bracket 158. This allows the antenna 20 to be installed by a single technician and overcomes the need for the use of a second installation technician.

Figure 9A:
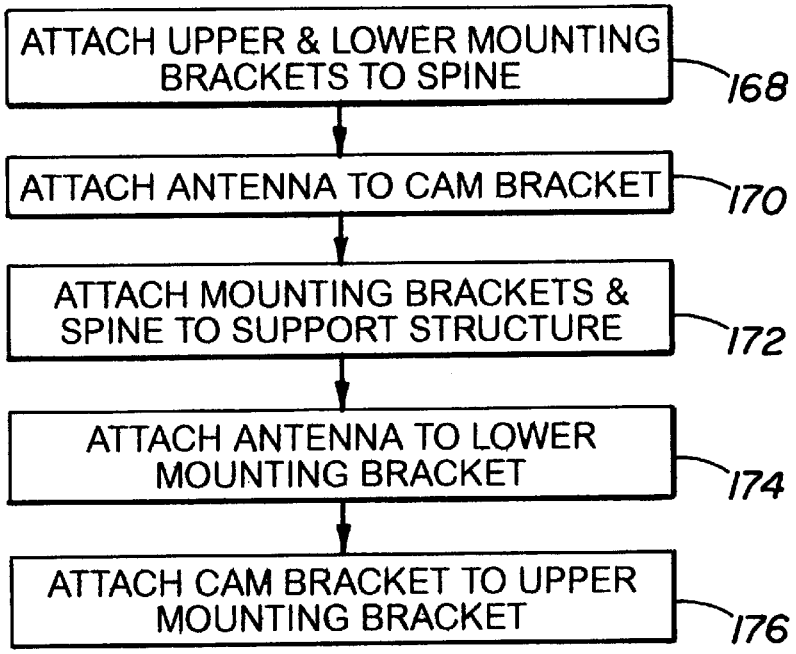
FIG. 9A is a flow diagram representing a method of attaching an antenna to an antenna mounting bracket assembly and to a support structure according to an exemplary embodiment of the present invention.
Figure 9B:
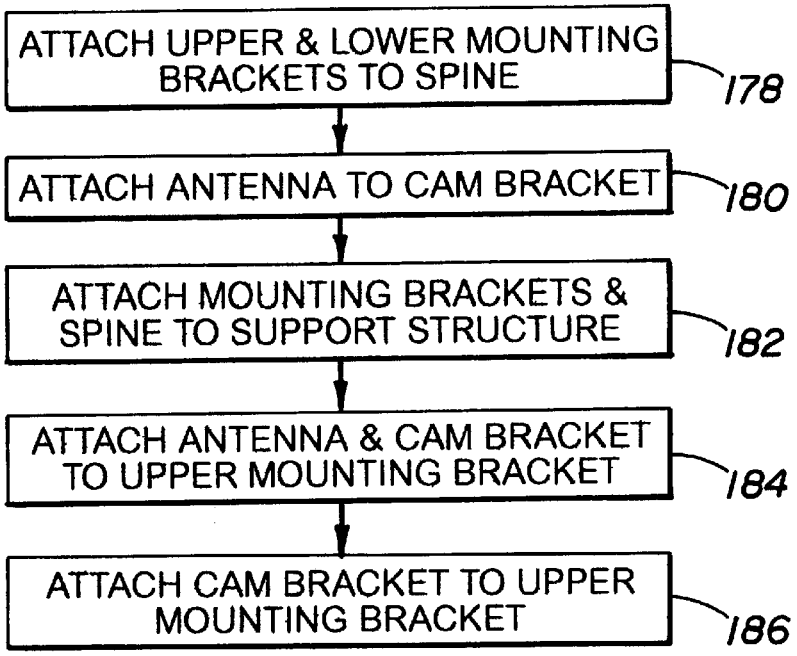
FIG. 9B is a flow diagram representing a method of attaching an antenna to an antenna mounting bracket assembly and to a support structure according to an exemplary embodiment of the present invention.

Turning now to FIGS. 9A and 9B, the present invention also comprises two methods for attaching an antenna 20 to an antenna mounting bracket assembly 10 and to a support structure, such as a vertical pole 22. Following the method of FIG. 9A and referring to FIG. 1, in Step 168, an upper mounting bracket 14 and a lower mounting bracket 16 are attached to a spine 12 so as to maintain the upper mounting bracket 14 and the lower mounting bracket 16 in a spaced-apart relationship along a vertical axis. In Step 170, a cam bracket 18 is attached to one end of an antenna 20 for slidably adjusting the downtilt position of the antenna 20 relative to the vertical axis of the support structure 17. In Step 172, the spine 12 is attached to the support structure 17. In Step 174, the antenna 20 is mounted upon the lower mounting bracket 16 for pivotal coupling of the antenna 20. In Step 176, the cam bracket 18 is attached to the upper mounting bracket 14 so as to allow the antenna's downtilt position to be adjusted through manipulation of the cam bracket 18.

Following the method of FIG. 9B and referring to FIGS. 1, 7 and 8, in Step 178, an upper mounting bracket 140 and a lower mounting bracket 158 are attached to a spine 12 so as to maintain the upper mounting bracket 140 and the lower mounting bracket 158 in a spaced-apart relationship along a vertical axis. In Step 180, a cam bracket 132 is attached to one end of an antenna 20 for slidably adjusting the downtilt position of the antenna 20 relative to the vertical axis of the support structure 17. In Step 182, the spine 12 is attached to the support structure 17. In Step 184, the antenna 20 and cam bracket 18 are mounted upon the upper mounting bracket 140 for pivotal coupling of the antenna 20. In Step 186, the cam bracket 132 is attached to the lower mounting bracket 158 so as to allow the antenna's downtilt position to be adjusted through manipulation of the cam bracket 132.

From the foregoing description of each component of the antenna mounting bracket assembly, those skilled in the art will appreciate that the present invention provides an antenna mounting bracket assembly that allows for proper vertical and rotational spacing of the brackets for mounting a cellular/PCS antenna. The present invention also reduces the number of separate pieces necessary for installation of such an antenna and, therefore, reduces the cost and time required to manufacture and install such an assembly. Further, the present invention reduces the number of installation technicians necessary for such installation and assembly from two to one.

Those skilled in the art will also appreciate that that present invention is applicable to a range of antennas having different heights, widths and profiles, including antennas other than those used for cellular/PCS applications. The invention is also applicable to allow for a wide range of antenna downtilt adjustment and can be configured so as to provide upwards tilt if so desired. Also, the present invention can be constructed out of a wide range of materials, including but not limited to sheet metal, aluminum, stainless steel and a variety of plastics.

It will be understood that only the claims that follow define the scope of the present invention and that the above description is intended to describe embodiments of the present invention. In particular, the scope of the present invention extends beyond any specific embodiment described within this description.

What is claimed is:

1. An antenna mounting bracket assembly for mounting an antenna to a support structure, comprising:

a cam bracket, adapted for connection to one end of the antenna, for slidably adjusting the downward tilt position of the antenna relative to the vertical axis of the support structure;

a first mounting bracket, adapted for connection to the support structure and operative to accept the cam bracket, for mounting the cam bracket in a selected position;

a second mounting bracket, adapted for connection to the support structure and operative to accept another portion of the antenna, for pivotal coupling to the antenna; and a spine, adapted for connection to the support structure, for maintaining the first and second mounting brackets in a spaced-apart relationship along a vertical axis, the first mounting bracket positioned above the second mounting bracket along the spine.

2. The antenna mounting bracket assembly of claim 1, wherein the second mounting bracket comprises a pair of spaced-apart mounting slots for slidably accepting an antenna assembly with a pre-attached mounting.

3. The antenna mounting bracket assembly of claim 2, wherein the second mounting bracket comprises a pair of "L"-shaped mounting slots for slidably accepting a horizontal connector attached to the other end of the antenna such that the horizontal connector extends between the two "L"-shaped slots so as to act as a pivoting mechanism for coupling the antenna to the second mounting bracket.

4. The antenna mounting bracket assembly of claim 3, wherein the second mounting bracket is connected to the lower end of the spine and below and parallel to the first mounting bracket, the second mounting bracket further comprising a horizontal cross bar mounted below and between the spaced-apart mounting slots for preventing the antenna from extending beyond a predetermined downwards tilt position when the antenna mount is placed into the spaced-apart mounting slots and the cam bracket is unattached to the first mounting bracket.

5. The antenna mounting bracket of claim 1, wherein the cam bracket comprises:

cam slots comprising spaced-apart radial slots placed in alignment with each other; and a guiding fastener, slidably moveable between the radial slots and adapted for connection to the antenna, wherein a desired downwards tilt position of the antenna is selectable in response to sliding the guiding fastener to a desired position along the radial slots and securing the guiding fastener;

wherein the cam bracket comprises pivot points comprising spaced-apart holes placed in alignment with each other and a pivoting fastener, pivotally movable within the holes and adapted for connection to the second mounting bracket.

6. The antenna mounting bracket assembly of claim 5, wherein the cam bracket further comprises a position indicator, connected to the guiding fastener, for identifying the angle of downwards tilt of the antenna.

7. The antenna mounting bracket assembly of claim 5, wherein the radial slots comprise detents extending along each of the slot edges, the detents operative to support a digital adjustment of the angle of downwards tilt of the antenna in response placing the guiding fastener within a selected pair of the detents.

8. The antenna mounting bracket assembly of claim 5, wherein the cam bracket further comprises a second set of radial mounting slots disposed below the of radial slots, the second set of radial mounting slots being adapted for accepting a second guiding fastener, and wherein the guiding fastener is adapted for attaching the cam bracket to the first mounting bracket and is capable of locking the position of the cam bracket and the downwards tilt position of the antenna.

9. The antenna mounting bracket assembly of claim 8, wherein the first mounting bracket further comprises a second pair of spaced-apart holes for pivotally accepting a connector that is adapted to slidably attach to and within the second set of radial mounting slots.

10. The antenna mounting bracket assembly of claim 1, wherein the first mounting bracket comprises a pair of spaced-apart holes for pivotally accepting a connector attached to the proximal end of the cam bracket.

11. The antenna mounting bracket assembly of claim 1, wherein the spine comprises a "V"-shaped channel, wherein the first mounting bracket is connected to the upper end of the spine and above the second mounting bracket and the second mounting bracket is connected to the lower end of the spine and below the first mounting bracket, such that the first and second mounting brackets are perpendicular to the vertical axis of the spine and are horizontally parallel with each other.

12. An antenna system, comprising:

an antenna;

a support structure;

a cam bracket, connected to one end of the antenna, for slidably adjusting the downward tilt position of the antenna relative to the vertical axis of the support structure;

a first mounting bracket, connected to the support structure and operative to accept the cam bracket, for mounting the cam bracket in a selected position;

a second mounting bracket, connected to the support structure and operative to accept another portion of the antenna, for pivotal coupling to the antenna; and a spine, connected to the support structure, for maintaining the first and second mounting brackets in a spaced-apart relationship along a vertical axis, the first mounting bracket positioned above the second mounting bracket along the spine.

13. The antenna system of claim 12, wherein the second mounting bracket comprises:

a pair of spaced-apart mounting slots for slidably accepting an antenna mount attached to the other end of the antenna; and a pair of "L"-shaped mounting slots for slidably accepting a horizontal connector attached to the other end of the antenna such that the horizontal connector extends between the two "L"-shaped slots so as to act as a pivoting mechanism for coupling the antenna to the second mounting bracket.

14. The antenna system of claim 13, wherein the second mounting bracket, connected to the lower end of the spine and below and parallel to the first mounting bracket, and comprises a horizontal cross bar mounted below and between the spaced-apart mounting slots for preventing the antenna from extending beyond a predetermined downwards tilt position when the antenna mount is placed into the spaced-apart mounting slots and the cam bracket is unattached to the first mounting bracket and where the second mounting bracket.

15. The antenna system of claim 12, wherein the cam bracket comprises:

cam slots comprising spaced-apart radial slots placed in alignment with each other; and a guiding fastener, slidably moveable between the radial slots and adapted for connection to the antenna, wherein a desired downwards tilt position of the antenna is selectable in response to sliding the guiding fastener to a desired position along the radial slots and securing the guiding fastener;

wherein the cam bracket comprises pivot points comprising spaced-apart holes placed in alignment with each other and a pivoting fastener, pivotally movable within the holes and adapted for connection to the second mounting bracket.

16. The antenna system of claim 15, wherein the cam bracket further comprises a position indicator, connected to the guiding fastener, for identifying the angle of downwards tilt of the antenna and the radial slots comprise detents extending along each of the slot edges, the detents operative to support a digital adjustment of the angle of downwards tilt of the antenna in response placing the guiding fastener within a selected pair of the detents.

17. The antenna system of claim 15, wherein the cam bracket further comprises a second set of radial mounting slots disposed below the of radial slots, the second set of radial mounting slots adapted for accepting a second guiding fastener, and wherein the guiding fastener is adapted for attaching the cam bracket to the first mounting bracket and is capable of locking the position of the cam bracket and the downwards tilt position of the antenna.

18. The antenna system of claim 17, wherein the first mounting bracket comprises:

a pair of spaced-apart holes for pivotally accepting a connector attached to the proximal end of the cam bracket; and a second pair of spaced-apart holes for pivotally accepting a connector that is adapted to slidably attach to and within the second set of radial mounting slots.

19. The antenna system of claim 12, wherein the spine comprises a "V"-shaped channel, wherein the first mounting bracket is connected to the upper end of the spine and above the second mounting bracket and the second mounting bracket is connected to the lower end of the spine and below the first mounting bracket, such that the first and second mounting brackets are perpendicular to the vertical axis of the spine and are horizontally parallel with each other.

20. A method for attaching an antenna to an antenna mounting bracket assembly and to a support structure, comprising the steps of:

attaching a upper mounting bracket and a lower mounting bracket to a spine, adapted for connection to a support structure, for maintaining the upper and lower mounting brackets in a spaced-apart relationship along a vertical axis;

attaching the antenna to a cam bracket, adapted for connection to one end of the antenna, for slidably adjusting the downward tilt position of the antenna relative to the vertical axis of the support structure;

attaching the two mounting brackets and the spine to the support structure;

attaching the antenna to the lower mounting bracket, adapted for connection to the support structure and operative to accept another portion of the antenna, for pivotal coupling to the antenna; and attaching the cam bracket to the upper mounting bracket, adapted for connection to the support structure and operative to accept the cam bracket, for mounting the cam bracket in a selected position.

21. A method for attaching an antenna to an antenna mounting bracket assembly and to a support structure, comprising the steps of:

attaching a upper mounting bracket and a lower mounting bracket to a spine, adapted for connection to a support structure, for maintaining the upper and lower mounting brackets in a spaced-apart relationship along a vertical axis;

attaching the antenna to a cam bracket, adapted for connection to one end of the antenna, for slidably adjusting the downward tilt position of the antenna relative to the vertical axis of the support structure;

attaching the two mounting brackets and the spine to the support structure;

attaching the cam bracket and the antenna to the upper mounting bracket, adapted for connection to the support structure and operative to accept the cam bracket, for mounting the cam bracket in a selected position; and attaching the antenna to the lower mounting bracket, adapted for connection to the support structure and operative to accept another portion of the antenna, for pivotal coupling to the antenna.

* * * * *